US008466215B2

(12) United States Patent
Knoll et al.

(10) Patent No.: US 8,466,215 B2
(45) Date of Patent: Jun. 18, 2013

(54) THERMOPLASTIC LINOLEUM

(75) Inventors: Konrad Knoll, Mannheim (DE); Michel Pepers, Ludwigshafen (DE); Peter Wolf, Kirchheim/Weinstraβe (DE); Piyada Charoensirisomboon, Mannheim (DE)

(73) Assignee: Sytrolution GmbH (DE)

( * ) Notice: Subject to any disclaimer, the term of this patent is extended or adjusted under 35 U.S.C. 154(b) by 406 days.

(21) Appl. No.: 12/747,369

(22) PCT Filed: Dec. 11, 2008

(86) PCT No.: PCT/EP2008/067316
§ 371 (c)(1),
(2), (4) Date: Jun. 10, 2010

(87) PCT Pub. No.: WO2009/074645
PCT Pub. Date: Jun. 18, 2009

(65) Prior Publication Data

US 2010/0261824 A1 Oct. 14, 2010

(30) Foreign Application Priority Data

Dec. 13, 2007 (EP) ..... 07123091

(51) Int. Cl.
*C08K 9/00* (2006.01)
*C09B 67/00* (2006.01)

(52) U.S. Cl.
USPC ..... 523/205; 524/502; 525/55

(58) Field of Classification Search
USPC ..... 524/502, 300; 526/321; 525/55, 525/384; 523/205
See application file for complete search history.

(56) References Cited

U.S. PATENT DOCUMENTS

| | | | | |
|---|---|---|---|---|
| 6,197,889 | B1 | 3/2001 | Knoll et al. | |
| 6,231,970 | B1 * | 5/2001 | Andersen et al. | 428/332 |
| 6,579,937 | B1 * | 6/2003 | Guntherberg et al. | 525/67 |
| 6,768,029 | B1 * | 7/2004 | Khan et al. | 568/469 |
| 6,861,128 | B1 * | 3/2005 | Muller et al. | 428/215 |
| 2007/0235187 | A1 * | 10/2007 | Goodman | 166/259 |

FOREIGN PATENT DOCUMENTS

| | | | |
|---|---|---|---|
| DE | 10001476 | | 9/2001 |
| EP | 0228116 | | 7/1987 |
| GB | 452944 | * | 6/1934 |
| JP | 3241083 | | 10/1991 |
| WO | WO-97/40079 | A1 | 10/1997 |
| WO | WO-2008/033899 | | 3/2008 |

OTHER PUBLICATIONS

Machine Translation of JP 03-241083 (Oct. 23, 1991).*
English-language Translation of International Preliminary Report on Patentability for PCT/EP2008/067316, mailed Sep. 26, 2009.

* cited by examiner

*Primary Examiner* — Hannah Pak
(74) *Attorney, Agent, or Firm* — Novak Druce Connolly Bove + Quigg LLP

(57) ABSTRACT

The present invention relates to a thermoplastic molding composition comprising
(A) as component A, particles composed of at least one oxidatively crosslinked vegetable oil as core, encapsulated by at least one thermoplastic,
(B) as component B, at least one further thermoplastic compatible with the at least one thermoplastic present in the shell of component A,
(C) as component C, at least one resin compatible with the at least one thermoplastic present in the shell of component A,
(D) as component D, at least one filler, and
(E) as component E, if appropriate, further additives,
and also to a process for the production of the thermoplastic molding composition.

20 Claims, No Drawings

THERMOPLASTIC LINOLEUM

CROSS REFERENCE TO RELATED APPLICATIONS

This application is a national stage application under 35 U.S.C. §371 of PCT/EP2008/067316, filed Dec. 11, 2008, which claims benefit to European application 07123091.6, filed Dec. 13, 2007, the entire disclosures of which are hereby incorporated by reference.

The present invention relates to a thermoplastic molding composition comprising particles composed of at least one oxidatively crosslinked vegetable oil as core, encapsulated by at least one thermoplastic, and comprising at least one further thermoplastic, at least one resin, at least one filler, and, if appropriate, further additives, to a process for the production of this molding composition, and to a material comprising a backing layer and this thermoplastic molding composition:

Linoleum is a floorcovering developed in 1863 by Frederick Walton, and mainly composed of oxidatively polymerized linseed oil, tree resins (colophonium), cork flour and wood flour, titanium oxide, dyes, and a jute textile. Advantages of linoleum are mainly the resistance to oils, fats, and tar. Linoleum is antistatic and has slightly fungicidal and bacteriostatic action with regard to various microorganisms. The cause of this effect is the ongoing emission of small amounts of various aldehydes, such as hexanal, acrolein, acetaldehyde, etc., which derive from atmospheric oxidation of linseed oil, which continues practically infinitely, or are residues from the oxidation reaction in the production process.

Examples of disadvantages of linoleum are that this typical linoleum odor has been demonstrated to be capable of triggering mucosal irritation and allergies in sensitive persons. Linoleum is moreover not very resistant to point loads, and is not suitable for use in wetrooms. Linoleum is moreover very easily damaged by alkalis and is chemically degraded by these.

Because petroleum reserves are becoming ever smaller, there is a constant demand for materials that can be obtained from naturally renewable resources. The mechanical properties, such as stiffness, load resistance, and mechanical and chemical resistance, of these materials should be equivalent to those of synthetically produced thermoplastic molding compositions known from the prior art. It is preferable that these thermoplastic molding compositions prepared from renewable raw materials have at least 50% of ingredients derived from natural sources. The costs for these new molding compositions should be comparable with those for synthetic molding compositions. The new thermoplastic molding compositions should moreover comply with the regulations and requirements for plastics used in the context of foods.

JP 03-241083 of Tajima Inc. discloses a floorcovering and a process for its production. This floorcovering is obtained by mixing a polymerizable vegetable oil, such as linseed oil, a thermoplastic elastomer, such as a styrene elastomer or styrene-butadiene block copolymer, a curing agent, such as trimethylolpropane trimethacrylate, and a filler, such as cork powder or wood chips, and converting them to the desired shape, and then irradiating them with high-energy radiation, for example, with UV radiation.

It is an object of the present invention to provide a thermoplastic molding composition which is mainly composed of substances of natural origin, and whose stiffness is comparable with that of impact-resistant polystyrene (HIPS), and which can be produced at low cost, and which complies with the regulations in relation to use in the food sector.

These objects are achieved using a thermoplastic molding composition comprising (A) as component A, particles composed of at least one oxidatively crosslinked vegetable oil as core, encapsulated by at least one thermoplastic.

(B) as component B, at least one further thermoplastic compatible with the at least one thermoplastic present in the shell of component. A, (C) as component C, at least one resin compatible with the at least one thermoplastic present in the shell of component A, (D) as component D, at least one filler, and (E) as component E, if appropriate, further additives.

The inventive object is moreover achieved via a process for the production of this molding composition, via a material, comprising a backing layer and a thermoplastic molding composition, and a floorcovering comprising this material, and via the use of the inventive thermoplastic molding composition in materials.

The thermoplastic molding composition according to the present invention is described in detail below.

Component A:

The inventive thermoplastic molding composition comprises, as component A, (A) particles composed of at least one oxidatively crosslinked vegetable oil as core, encapsulated by at least one thermoplastic.

Suitable vegetable oils which according to the invention are oxidatively crosslinked, and which are present in this oxidatively crosslinked form in the particle according to component A in the thermoplastic molding composition are mentioned in *Drying oils and related products,* 2005, Verlag Wiley-VCH, Weinheim, pages 1 to 16.

Examples of preferred vegetable oils are linseed oil, perilla oil, tung oil, oiticica oil, fish oils, safflower oil, sunflower oil, soybean oil, cottonseed oil, and mixtures thereof. Linseed oil is preferably used.

These oils can be obtained on an industrial scale via cold or hot pressing of the corresponding seeds. Distillation can be used if appropriate to purify the oils obtained.

The crosslinking of the vegetable oil present in component A of the inventive thermoplastic molding composition is brought about via oxidation, see also *Drying oils and related products,* 2005, Verlag Wiley-VCH, Weinheim, pages 1 to 16.

In the case of oils having non-conjugated double bonds, the first step of the crosslinking reaction via oxidation consists in the formation of hydroperoxides in the allyl position with respect to the double bonds. A free radical is first formed via dehydrogenation, and is converted to the hydroperoxide via addition of oxygen. Isomerization of the double bonds remaining in the molecule can then sometimes take place. The next step in the crosslinking of the vegetable oils mentioned is the formation of a peroxy radical via degradation of the hydroperoxide. A free-radical chain-formation process is then initiated, and oxygen bonds or carbon-carbon bonds are formed. The recombination of free radicals is a terminating reaction in this step of the process.

In the case of oils having conjugated double bonds, the first step is not the formation of hydroperoxides but instead cyclic peroxides are formed via direct attack of oxygen at the conjugated bond system. Reaction of these peroxides with allylic methylene groups or dissociation provides free radicals which form carbon-oxygen bonds and carbon-carbon bonds in a free-radical chain mechanism. This reaction, too, can be terminated via recombination of the free radicals or disproportionation.

Any of the oxidants known to the person skilled in the art can generally be used for the oxidation of the vegetable oils mentioned.

The crosslinking of the vegetable oils mentioned via oxidation can be catalyzed by suitable catalysts. Suitable catalysts are any of the metals which can exist in various oxidation states and which can enter into redox reactions. Suitable metals for the crosslinking of vegetable oils are those selected from the group consisting of cobalt, iron, manganese, cerium, lead, zirconium, and mixtures of these metals.

The oxidatively crosslinked vegetable oils present in the core of the particles can also be obtained by passage of air at a temperature which is generally from 80 to 140° C., preferably from 90 to 120° C. In this process, hydroperoxides are formed and decompose into free radicals and thus increase the molecular weight via a free-radical chain-transfer reaction.

The degree of crosslinking of the oxidatively crosslinked vegetable oils can be determined via rheological methods or via measurement of the degree of swelling. These methods are known to the person skilled in the art.

The particles which are used as component A in the inventive thermoplastic molding composition are encapsulated by at least one thermoplastic.

The thermoplastic is any of the polymers, i.e. homo- and copolymers, which can be deformed reversibly within a certain temperature range, and reversible here means that this procedure can be repeated any desired number of times via cooling and reheating as far as the molten state, as long as no thermal decomposition of the material occurs as a result of overheating.

Any of the thermoplastics known to the person skilled in the art can generally be used as shell for the particles present as component A in the inventive thermoplastic molding composition.

Examples among the thermoplastics are polyamides (PA), polyetherether ketones (PEEK), polyesters, such as polyethylene terephthalate (PET), or polybutylene terephthalate (PBT), polyvinyl chloride (PVC), polyurethane (PU), polyoxymethylene (POM), polyether sulfone (PES), poly-n-butyl methacrylate (PBMA), polymethyl methacrylate (PMMA), polyimides, or styrene-acrylonitrile (SAN).

It is preferable to use thermoplastics selected from the group consisting of homo- and copolymers composed of vinylic, aromatic monomers, ethylenically unsaturated monomers, and/or dienes.

Suitable vinylic, aromatic monomers correspond to the general formula (I)

(I)

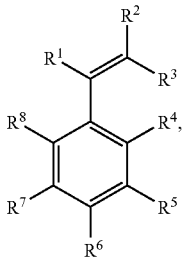

where $R^1$ to $R^8$, independently of one another, can be hydrogen, $C_1$-$C_{20}$-alkyl, $C_2$-$C_{20}$-alkenyl, $C_2$-$C_{20}$-alkynyl, or $C_5$-$C_{20}$-aryl, where the alkyl, alkenyl, and alkynyl radicals can be linear or branched and can, if appropriate, have substitution by functional groups selected from the group consisting of amine group, imine group, ether group, hydroxy group, aldehyde group, keto group, carboxylic acid group, carboxylic anhydride group, and nitrite group. In one preferred embodiment, $R^1$ to $R^3$ are, independently of one another, hydrogen or $C_1$-$C_{20}$-alkyl, particularly preferably hydrogen, methyl, ethyl, or propyl, and $R^4$ to $R^8$ are, independently of one another, hydrogen, methyl, or ethyl. It is very particularly preferable that $R^1$ is hydrogen or methyl, and that $R^2$ to $R^3$ are hydrogen. In one particularly preferred embodiment, the vinylic, aromatic monomers used comprise styrene, α-methylstyrene, para-methylstyrene, 1,1-diphenylethylene, para-tert-butylstyrene, or a mixture.

Suitable ethylenically unsaturated monomers are generally those selected from the group consisting of α,β-unsaturated mono- and dicarboxylic acids, and their esters, anhydrides, and nitrites.

Preferred α,β-unsaturated monocarboxylic acids are acrylic acid and methacrylic acid.

Preferred esters of these α,β-unsaturated monocarboxylic acids are reaction products of the monocarboxylic acid mentioned with compounds which bear at least one OH function, i.e. with mono- or polyhydric alcohols.

Preferred methacrylic esters are $C_1$-$C_8$-alkyl esters of methacrylic acid, for example methyl methacrylate (MMA), ethyl methacrylate, n-propyl methacrylate, isopropyl methacrylate, n-butyl methacrylate, isobutyl methacrylate, sec-butyl methacrylate, tert-butyl methacrylate, pentyl methacrylate, hexyl methacrylate, heptyl methacrylate, octyl methacrylate, or 2-ethylhexyl methacrylate.

Preferred acrylic esters are $C_1$-$C_8$-alkyl esters of acrylic acid, for example methyl acrylate, ethyl acrylate, n-acrylate, isopropyl acrylate, n-butyl acrylate, isobutyl acrylate, sec-butyl acrylate, tert-butyl acrylate, pentyl acrylate, hexyl acrylate, heptyl acrylate, octyl acrylate, or 2-ethylhexyl acrylate.

It is also possible to use a mixture of two or more acrylates and/or methacrylates.

Suitable nitrites of α,β-unsaturated monocarboxylic acids are acrylonitrile and methacrylonitrile, preference being given to acrylonitrile.

Examples of suitable α,β-unsaturated dicarboxylic acids and α,β-unsaturated dicarboxylic anhydrides are maleic acid or maleic anhydride.

According to the invention, any of the homo- or copolymerizable dienes can be present in the thermoplastic forming the shell of the particle in component A. It is preferable to use 1,3-dienes, particularly preferably 1,3-butadiene, 2,3-dimethylbutadiene, piperylene and/or isoprene.

In one particularly preferred embodiment, polystyrene is used as shell of the particle present as component A. Polystyrene can be prepared by any of the processes known to the person skilled in the art, examples being cationic, anionic, or free-radical-initiated polymerization, in emulsions, solutions, or bulk. The weight-average molar mass of the polystyrene present as shell in the particle is from 80 000 to 300 000 g/mol, for example from 100 000 to 200 000 g/mol.

In another particularly preferred embodiment, a copolymer composed of styrene and acrylonitrile is used as shell of the particle present as component A. The weight-average molar mass of this "SAN copolymer" is generally from 80 000 to 300 000 g/mol, for example from 100 000 to 200 000 g/mol. Processes for the production of a suitable SAN copolymer are known to the person skilled in the art.

The binding of the at least one thermoplastic to the oxidatively crosslinked vegetable oil present in the core can take place via interactions or via covalent bonding, in each case between the molecules of the thermoplastic and the molecules of the crosslinked vegetable oil in the core.

In another preferred embodiment, a block rubber or graft rubber is additionally present in the particle used as component A. According to the invention, it is possible to use any of the block rubbers or graft rubbers known to the person skilled in the art. It is preferable to use, in component A, ABS copolymers, butadiene-styrene copolymers or block copolymers which have at least one hard block composed of at least one styrene monomer or one derivative thereof, and at least one block composed of a styrene monomer, and also of at least one diene, examples being SBS copolymers. If rubbers are used according to the invention, these are preferably added in non-agglomerated form.

ABS copolymers are copolymers composed of acrylic acid, butadiene, and styrene. Processes for the production of ABS copolymers are known to the person skilled in the art.

SBS copolymers are block copolymers composed of styrene and butadiene. SBS copolymers and processes for their production are described by way of example in WO 97/40079. These block polymers are prepared via anionic polymerization in a non-polar solvent, using initiation by means of organometallic compounds. Preference is given to compounds of the alkali metals, particularly of lithium. Examples of initiators are methyllithium, ethyllithium, propyllithium, n-butyllithium, sec-butyllithium, and tert-butyllithium. The organometallic compound is added in the form of a solution in a chemically inert hydrocarbon. The amount added depends on the desired molecular weight of the polymer, but is generally in the range from 0.002 to 5 mol %, based on the monomers. Solvents used preferably comprise aliphatic hydrocarbons, such as cyclohexane or methylcyclohexane.

According to the invention, the random blocks of the block copolymers comprising styrene together with diene are produced with addition of a soluble potassium salt, in particular of a potassium alcoholate, in particular tertiary alcoholates having at least 7 carbon atoms. Examples of typical corresponding alcohols are 3-ethyl-3-pentanol and 2,3-dimethyl-3-pentanol. Tetrahydrolinalool (3,7-dimethyl-3-octanol) has proven particularly suitable. In principle, other potassium salts which are inert toward alkylmetal compounds are suitable, alongside the potassium alcoholates. Mention may be made here of dialkylpotassium amides, alkylated diarylpotassium amides, alkyl thiolates, and alkylated aryl thiolates. The polymerization temperature can be from 0 to 130° C.

In one embodiment of the present invention, particles particularly preferably used as component A comprise linseed oil as vegetable oil, and an SBS block copolymer as rubber, and have been encapsulated with polystyrene. In another preferred embodiment, the particles used as component A comprise linseed oil as vegetable oil, a graft rubber based on styrene and/or butadiene, and a shell composed of a styrene-acrylonitrile copolymer.

The diameter of the particles present as component A in the inventive thermoplastic molding composition is generally from 1 to 100 μm, preferably from 1 to 10 μm. The layer thickness of the shell of the particle present as component A is generally from 10 to 30 nm. The amount of the oxidatively crosslinked vegetable oil present in the inventive thermoplastic molding composition is from 10 to 60% by weight, preferably from 20 to 50% by weight, particularly preferably from 25 to 45% by weight, based in each case on the entire thermoplastic molding composition.

The amount of component A present in the inventive thermoplastic molding composition is generally from 10 to 70% by weight, preferably from 40 to 60% by weight, based in each case on the entire thermoplastic molding composition.

Component B:

The inventive thermoplastic molding composition comprises, as component B, at least one further thermoplastic, compatible with the at least one thermoplastic present in the shell of component A. For the purposes of the present invention, "compatible" means that no incompatibility reactions occur between the two thermoplastics, examples being decomposition, demixing, chemical reactions, discoloration phenomena, or adverse effects on the mechanical properties of the thermoplastic molding composition according to the present invention.

Thermoplastics suitable as component B are those selected from the group consisting of copolymers of at least one vinylic, aromatic monomer and, if appropriate, of at least one α,β-unsaturated monocarboxylic acid or the corresponding nitrile, examples being polystyrene (PS) or styrene-acrylonitrile (SAN). Other suitable thermoplastics are those selected from the group consisting of polycarbonates (PC), polyurethanes (PU), polyamides (PA), polyesters, such as polyethylene terephthalates (PET) or polybutylene terephthalates (PBT), polyetherether ketones (PEEK), polyvinyl chlorides (PVC), polyurethanes (PU), polyoxymethylenes (POM), polyether sulfones (PES), poly-n-butyl methacrylates (PBMA), polymethyl methacrylates (PMMA), polyimides, and biodegradable homo- and copolymers, such as polylactides or polybutyrate.

In one preferred embodiment, the at least one further thermoplastic used as component B is selected from the group consisting of polystyrenes, polyesters, styrene-acrylonitrile copolymers, polycarbonates, polyurethanes and biodegradable polymers, for example polylactides or polybutyrate.

Processes for the production of polystyrene and of copolymers of styrene and acrylonitrile have been explained above.

Polycarbonates are polymers formally obtainable via reaction of carbonic acid and compounds having at least two hydroxy functions. By way of example, they are accessible via reaction of the corresponding alcohols with phosgene or carbonic diesters in polycondensation and transesterification reactions.

Polyesters suitable for the inventive thermoplastic molding composition are preferably those selected from the group consisting of polyethylene terephthalate, polybutylene terephthalate, polytrimethylene terephthalate, and blends thereof. Polyesters can be obtained via reaction of diols with dicarboxylic acids or reaction of hydroxycarboxylic acids.

Polyurethanes are copolymers obtained via polyaddition of compounds having at least two hydroxy functions and compounds which have at least two isocyanate groups. Examples of polyurethanes to be used according to the invention are those produced from polyester- and/or polyetherdiols and, for example, from toluene 2,4- or 2,6-diisocyanate, methylene 4,4'-di(phenyl isocyanate), and hexamethylene diisocyanate. Linear or branched polyurethanes can be used.

In one preferred embodiment, a biodegradable polymer is used as component B in the inventive thermoplastic molding composition. Examples of biodegradable polymers are polylactides or polybutyrate.

Polylactides, also termed polylactic acids, occur in the optically active D- or L-form, by virtue of the asymmetric carbon atom. Polylactides that can be used according to the invention can be prepared by any of the processes known to the person skilled in the art.

By way of example, polylactides are accessible via the ionic polymerization of lactide, a cyclic adduct of two lactic acid molecules. Polylactide is formed in a ring-opening polymerization reaction at temperatures of from 140 to 180° C. with exposure to catalytic tin compounds, such as tin oxide. Lactide itself can be produced via fermentation of molasses or via fermentation of glucose, with the aid of various bacteria. High-molecular-weight, and pure, polylactides can moreover be produced directly from lactic acid via polycondensation.

Component B can also be a mixture of the thermoplastics mentioned with one another, or a mixture of the thermoplastics mentioned with one another and with what are known as "toughness boosters" as additive, these preferably having been selected from the group consisting of SBS copolymers, marketed by way of example with trademark Styroflex® or or with trademark Ecoflex®. Ecoflex® is a mixture of aromatic and aliphatic esters based on poly-epsilon-caprolactone and 1,4-butanediol. Statements above are applicable to the SBS copolymers.

The amounts of these additives present are generally known to the person skilled in the art as suitable.

In one preferred embodiment, if the shell of the particle comprises polystyrene, component B likewise uses polystyrene, if appropriate in a mixture with an SBS copolymer. In another preferred embodiment, if the shell of the particle comprises styrene-acrylonitrile, component B likewise uses styrene-acrylonitrile, or uses polyester, polyurethane, or polylactide, if appropriate in a mixture with Ecoflex®.

The amount of the thermoplastic material used as component B present in the thermoplastic molding composition of the present invention is from 20 to 80% by weight, preferably from 30 to 70% by weight, particularly preferably from 40 to 60% by weight, based in each case on the total weight of the thermoplastic molding composition.

Component C:

The thermoplastic molding composition according to the present invention comprises, as component C, at least one resin compatible with the at least one thermoplastic present in the shell of component A.

According to the invention, either synthetically produced resins or else naturally occurring resins can be used.

*Natural Resins*, Wiley-VCH Verlag, Weinheim, 2005, pages 1 to 19 discloses a selection of natural resins which can be used in the thermoplastic molding composition according to the present invention.

Particularly preferred natural resins are those selected from the group consisting of acaroid resin, amber, asphaltite, Peru balsam, Toru balsam, benzoin, Canada balsam, Chinese or Japanese lacquer, copal, damar, dragon's blood resin, elemi, olibanum, galbanum, labdanum, mastic, myrrh, gum juniper, shellac, styrax, Utah resin, Venetian turpentine, colophonium, and mixtures thereof. Colophonium is particularly preferably used.

These resins occur in nature and can be isolated or obtained by processes known to the person skilled in the art, for example by making an incision in the bark of the corresponding tree and collecting the resin, or extracting the wood of the corresponding tree with suitable solvents, such as naphtha.

Suitable synthetically produced resins are generally copolymers, for example low-molecular-weight thermoplastic materials. e.g. low-molecular-weight polyesters. These are known to the person skilled in the art.

The amount of component C present in the inventive thermoplastic molding composition is generally from 1 to 30% by weight, preferably from 5 to 20% by weight, particularly preferably from 8 to 15% by weight, based in each case on the total weight of the inventive thermoplastic molding composition.

Component D:

The inventive thermoplastic molding composition comprises, as component D, at least one filler. Any of the fillers known to the person skilled in the art and suitable for use in polymeric materials can be used as component D. Examples of suitable fillers are mineral fillers, salts, for example carbonates of the alkali metals and of the alkaline earth metals, e.g. calcium carbonate, or compounds such as titanium dioxide, zirconium dioxide, and mixtures thereof.

Other suitable fillers are those selected from the group consisting of cork flour, for example from recycled bottle corks, and wood flour, for example sawdust.

A particularly preferred filler used is calcium carbonate.

The suitable particle size for the filler used as component D is known to the person skilled in the art.

The amount of component D generally present is up to 50% by weight, preferably from 20 to 30% by weight.

Component E:

If appropriate, further additives can be present as component E in the inventive thermoplastic molding composition.

Examples of suitable further additives are dyes. UV stabilizers, bleaches, deodorants, antioxidants, and mixtures thereof.

If further additives are comprised as component E in the thermoplastic molding composition, the amount of component E generally present is from 0.1 to 2% by weight, preferably from 1 to 2% by weight, all based on the entire thermoplastic molding composition.

The total of the amounts of the components A, B, C, D, and, if appropriate, E present in the inventive thermoplastic molding composition is 100% by weight.

The present invention also provides a process for the production of a thermoplastic molding composition comprising, as component A, particles composed of at least one oxidatively crosslinked vegetable oil as core, encapsulated by at least one thermoplastic, as component B, at least one further thermoplastic compatible with the at least one thermoplastic present in the shell of component A, as component C, at least one resin compatible with the at least one thermoplastic present in the shell of component A, at least one filler, and as component E, if appropriate, further additives comprising the steps of:

(1) production of a solution or dispersion of at least one thermoplastic in at least one vegetable oil, (2) oxidation of the at least one vegetable oil in the solution or dispersion from step (1), in order to obtain particles which comprise the at least one oxidatively crosslinked vegetable oil as core, encapsulated by at least one thermoplastic, and (3) mixing of the particles from step (2) with components (B), (C), (D), and, if appropriate, (E), in order to obtain the thermoplastic molding composition.

The individual steps of the inventive process are described in more detail below:

Step (1):

Step (1) of the inventive process comprises the preparation of a solution or of a dispersion of at least one thermoplastic in the at least one vegetable oil.

In step (1) of the process according to the present invention, a solution or a dispersion of the at least one thermoplastic in the at least one vegetable oil is prepared as a function of the extent to which the at least one thermoplastic is soluble in the at least one vegetable oil. It is preferable that a solution is prepared. The amount of the at least one thermoplastic here in the at least one vegetable oil is generally the amount also intended to be present in the subsequent component (A).

The statements made above in relation to the inventive thermoplastic molding composition are applicable in relation to the vegetable oil and to the thermoplastic.

The preparation of the solution or of the dispersion can be effected by any of the processes known to the person skilled in the art. In one preferred embodiment, the at least one vegetable oil is heated and the at least one thermoplastic is then added to it. The temperature of the heated vegetable oil on addition of the at least one thermoplastic is generally from 50 to 150° C., preferably from 60 to 140° C. The solution or the dispersion is generally prepared at atmospheric pressure in step (1) of the inventive process, but the inventive process can also be carried out at a pressure below atmospheric pressure or at a pressure above atmospheric pressure.

Step (2):

Step (2) of the inventive process comprises the oxidation of the at least one vegetable oil in the solution or dispersion from step (1), in order to obtain particles which have the at least one oxidatively crosslinked vegetable oil as core and the at least one thermoplastic as shell.

The oxidation reaction can be carried out by any of the processes known to the person skilled in the art. Suitable oxidants are those selected from the group consisting oxidizing gases, such as oxygen, halogens, hydrogen peroxide, inorganic peroxides, organic peroxides, air, liquid or dissolved or dispersed oxidants, and mixtures of these oxidants. In one preferred embodiment, the oxidation reaction in step (2) of the inventive process takes place via passage of air through the solution or through the dispersion from step (1). The temperature in step (2) of the inventive process is generally above 110° C., preferably from 115 to 150° C.

In one preferred embodiment, step (2) of the inventive process is carried out in the presence of a catalyst. Suitable catalysts are metals and metal compounds which can exist in various oxidation states and can undergo redox reactions. Examples of metals which can be used as oxidization catalysts are those selected from the group consisting of cobalt, iron, manganese, cerium, lead, zirconium, and mixtures thereof. The oxidation reaction in step (2) of the inventive process is preferably carried out in the presence of a manganese catalyst.

Suitable compounds of the catalytically active compounds are organic and inorganic salts and complex compounds. Manganese oleate is mentioned by way of example.

The amount used of the catalytically active metals in step (2) of the inventive process is from 0.001 to 2% by weight. According to the invention, preferably at least one further salt is additionally used and serves for regeneration of the catalytically active compound, an example being a zinc salt, preferably a zinc alcoholate. The amount used of this additional compound is the same as that of the catalytically active compound or is a 2-, 3- 4-, or 5-fold excess in relation to the catalytically active compound.

In one preferred embodiment of the inventive process, admixture of the catalytically active metal compound takes place before step (1) is complete. In another preferred embodiment, the catalytically active metal is not removed after completion of the inventive process, and the resultant thermoplastic molding composition therefore comprises, alongside components A to D and, if appropriate, E, the appropriate amount of metal salt.

The oxidation reaction is generally continued until the degree of crosslinking of the vegetable oil to be crosslinked oxidatively has achieved the desired value. This can be established via a rise in the viscosity of the solution or of the dispersion during the oxidation reaction. The reaction time is generally from 0.1 to 8 hours, preferably from 0.5 to 6 hours, particularly preferably from 1 to 4 hours. However, the reaction time for the oxidation step (2) is dependent on the vegetable oil used, on the thermoplastic present, on the oxidant used, on the catalyst used, and also on the concentration of the thermoplastic in the vegetable oil, and can readily be determined by the person skilled in the art via observation of the viscosity rise.

Once the oxidation reaction has ended, particles have formed in the solution or in the dispersion, and the at least one vegetable oil is present in oxidatively crosslinked form in their core. The mechanism or the individual steps of the reaction has/have been explained above in relation to the thermoplastic molding composition. The at least one thermoplastic is present in the shell of the particle produced in step (2), and the molecular chains of this thermoplastic have been bonded covalently or coordinatively to the oxidatively crosslinked vegetable oil.

The statements made in relation to the inventive thermoplastic molding composition are applicable in relation to the particle size and the layer thickness of the shell composed of at least one thermoplastic.

Step (3):

Step (3) of the inventive process comprises the mixing of the particles from step (2) with components (B), (C), (D), and, if appropriate, (E), in order to obtain the molding composition.

Processes for mixing of the components mentioned are known to the person skilled in the art, examples being those selected from compounding, extrusion, or kneading. The mixing in step (3) takes place at a suitable temperature at which the individual components are miscible, for example from 50 to 200° C.

The statements made above in relation to the inventive thermoplastic molding composition are applicable in relation to components (B), (C), (D), and, if appropriate, (E). In one preferred embodiment, the inventive process produces an inventive thermoplastic molding composition.

The present invention also provides a material, comprising a backing layer or fibers and a thermoplastic molding composition according to the present invention.

Textiles composed of synthetically produced or naturally obtainable fibers can be used as backing layer. Examples of natural fibers are cotton, jute, or linen. Examples of synthetically produced fibers are fibers composed of homo- and copolymers selected from the group consisting of polyesters, polyamides, polyolefins, and blends of the abovementioned polymers. According to the invention, it is also possible to use glass fibers, preferably of conventional dimensions, where according to the invention these do not form a textile.

The inventive material is obtained by applying the inventively produced thermoplastic molding composition in the form of melt or in solution or dispersion to the backing layer, or by mixing it with the glass fibers.

The inventively produced material can be used as floorcovering, wallcovering, or for the cladding of furniture, or in the automobile sector, in wetrooms, for example in the bath and WC sector, in housings, or in components.

The present invention therefore also provides a floorcovering, wallcovering, item of furniture, or automobile parts, housings, or components, which comprise the inventive material.

The present invention moreover provides the use of the thermoplastic molding composition according to the present invention in materials.

The invention claimed is:

1. A thermoplastic molding composition comprising (A) as component A, particles composed of at least one oxidatively crosslinked vegetable oil as core, encapsulated by at least one thermoplastic shell, (B) as component B, at least one further thermoplastic compatible with the at least one thermoplastic present in the shell of component A, (C) as component C, at least one resin compatible with the at least one thermoplastic present in the shell of component A, (D) as component D, at least one filler, and (E) as component E, if appropriate, further additives.

2. The molding composition according to claim 1, which additionally comprises at least one block rubber or graft rubber.

3. The molding composition according to claim 1, wherein the thermoplastic present in the shell of component A is selected from homo- and copolymers composed of vinylic, aromatic monomers, ethylenically unsaturated monomers, dienes and combinations thereof.

4. The molding composition according to claim 1, wherein the thermoplastic as component B is selected from homo- and copolymers composed of vinylic, aromatic monomers, ethylenically unsaturated monomers, dienes and combinations thereof.

5. The molding composition according to claim 1, wherein the resin used as component C is selected from the group consisting of acaroid resin, amber, asphaltite, Peru balsam, Toru balsam, benzoin, Canada balsam, Chinese or Japanese lacquer, copal, damar, dragon's blood resin, elemi, olibanum, galbanum, labdanum, mastic, myrrh, gum juniper, shellac, Utah resin, Venetian turpentine, colophonium, and mixtures thereof.

6. The molding composition according to claim 1, wherein the filler used as component C is calcium carbonate.

7. A process for the production of a thermoplastic molding composition comprising, as component A, particles composed of at least one oxidatively crosslinked vegetable oil as core, encapsulated by at least one thermoplastic shell, as component B, at least one further thermoplastic compatible with the at least one thermoplastic present in the shell of component A, as component C, at least one resin compatible with the at least one thermoplastic present in the shell of component A, as component D, at least one filler, and as component E, if appropriate, further additives comprising the steps of:

(1) production of a solution or dispersion of at least one thermoplastic in at least one vegetable oil, (2) oxidation of the at least one vegetable oil in the solution or dispersion from step (1), in order to obtain particles which comprise the at least one oxidatively crosslinked vegetable oil as core, encapsulated by at least one thermoplastic shell, and (3) mixing of the particles from step (2) with components (B), (C), (D), and, if appropriate, (E), in order to obtain the thermoplastic molding composition.

8. The process according to claim 7, wherein the oxidation in step (2) is carried out in the presence of a manganese catalyst.

9. The process according to claim 7, wherein the oxidation is carried out at a temperature above 115° C.

10. A material comprising a backing layer or fibers and the thermoplastic molding composition according to claim 1.

11. The material according to claim 10, wherein the backing layer is a jute textile.

12. A floorcovering, wallcovering, item of furniture, automobile part, a housing or a component, comprising a material according to claim 10.

13. A method comprising utilizing the thermoplastic molding composition according to claim 1 in a floor covering, item of furniture, automobile part, a housing, or a component.

14. The molding composition according to claim 2, wherein the thermoplastic present in the shell of component A is selected from homo- and copolymers composed of vinylic, aromatic monomers, ethylenically unsaturated monomers, dienes and combinations thereof.

15. The molding composition according to claim 2, wherein the thermoplastic used as component B is selected from homo- and copolymers composed of vinylic, aromatic monomers, ethylenically unsaturated monomers, dienes and combinations thereof.

16. The molding composition according to claim 3, wherein the thermoplastic used as component B is selected from homo- and copolymers composed of vinylic, aromatic monomers, ethylenically unsaturated monomers, dienes and combinations thereof.

17. The molding composition according to claim 2, wherein the resin used as component C is selected from the group consisting of acaroid resin, amber, asphaltite, Peru balsam, Toru balsam, benzoin, Canada balsam, Chinese or Japanese lacquer, copal, damar, dragon's blood resin, elemi, olibanum, galbanum, labdanum, mastic, myrrh, gum juniper, shellac, Utah resin, Venetian turpentine, colophonium, and mixtures thereof.

18. The molding composition according to claim 3, wherein the resin used as component C is selected from the group consisting of acaroid resin, amber, asphaltite, Peru balsam, Toru balsam, benzoin, Canada balsam, Chinese or Japanese lacquer, copal, damar, dragon's blood resin, elemi, olibanum, galbanum, labdanum, mastic, myrrh, gum juniper, shellac, Utah resin, Venetian turpentine, colophonium, and mixtures thereof.

19. The molding composition according to claim 4, wherein the resin used as component C is selected from the group consisting of acaroid resin, amber, asphaltite, Peru balsam, Toru balsam, benzoin, Canada balsam, Chinese or Japanese lacquer, copal, damar, dragon's blood resin, elemi, olibanum, galbanum, labdanum, mastic, myrrh, gum juniper, shellac, Utah resin, Venetian turpentine, colophonium, and mixtures thereof.

20. The molding composition according to claim 2, wherein the filler used as component C is calcium carbonate.

* * * * *